United States Patent [19]

Lyness et al.

[11] 3,998,690

[45] Dec. 21, 1976

[54] FIBROUS ASSEMBLIES FROM CATIONICALLY AND ANIONICALLY CHARGED FIBERS

[75] Inventors: Warren Irl Lyness; Robert Andrew Gloss; Norman Andrew Bates, all of Cincinnati, Ohio

[73] Assignee: The Procter & Gamble Company, Cincinnati, Ohio

[22] Filed: Oct. 2, 1972

[21] Appl. No.: 293,970

[52] U.S. Cl. ..... 162/141; 162/145; 162/146; 162/183

[51] Int. Cl.[2] ..... D21F 11/00

[58] Field of Search ..... 162/141, 182, 164, 146, 162/183, 168, 175, 176, 181 A, 181 C, 179, 164 R, 164 EP, 168 R, 166, 157 C, 168 N, 145

[56] References Cited

UNITED STATES PATENTS

| | | | |
|---|---|---|---|
| 2,658,828 | 11/1953 | Pattilloch | 162/182 |
| 3,151,017 | 9/1964 | Brafford | 162/141 |
| 3,409,500 | 11/1968 | Strazdins et al. | 162/182 |

*Primary Examiner*—S. Leon Bashore
*Assistant Examiner*—Peter Chin
*Attorney, Agent, or Firm*—Rose Ann Dabek; Jerry J. Yetter; Richard C. Witte

[57] ABSTRACT

Fibrous assemblies, such as paper, having advantageous properties related to bulk, absorbency, and compaction resistance are obtained from discrete fiber aggregates by a process which comprises contacting a slurry of anionically charged fibers with a slurry of cationically charged fibers to form said discrete fiber aggregates and thereafter forming fibrous assemblies by conventional processes.

6 Claims, No Drawings

FIBROUS ASSEMBLIES FROM CATIONICALLY AND ANIONICALLY CHARGED FIBERS

BACKGROUND OF THE INVENTION

This invention relates to fibrous assemblies, and to a process for their preparation. More specifically, this invention relates to paper products, which find utility as toweling and sanitary products, and to a process for their preparation. Said products are characterized by enhanced wet strength, absorbency, softness, good drape, and enhanced bulk which exhibits compaction resistance, that is, a bulk which persists substantially undiminished even though the product be wetted.

Further, this invention relates to a process in which the above-described products can be obtained from relatively short fibers. For example, with respect to papermaking cellulosic fibers, the term short fibers is descriptive of fibers originating from the so-called hardwoods, i.e., the angiosperms, where the fibers typically have a length ranging from 1.0 to 2.0 mm. Such woods are normally pulped by the sulphite process. This is to be contrasted with long fibers which originate, for example, from the so-called soft woods, i.e., the gymnosperms, which typically have fiber lengths ranging from about 3..5 to 5.0 mm; such woods are normally pulped by the more expensive Kraft process.

While cellulosic fibers have been specifically named it is to be emphasized at the outset that the present invention contemplates all fibers: natural, synthetic, or blends thereof. Also it is to be emphasized that while economic considerations make utilization of short fibers most attractive, this invention is not restricted to short fibers but fully contemplates all fibers typically employed in the paper, felt, and allied arts; that is, plant fibers, such as cotton, esparto, straw, wood, etc.; synthetic fibers, such as rayon, nylon, glass, etc.; animal fibers, such as wool, fur, hair, silk, etc.; and mineral fibers, such as asbestos.

With respect to the paper product embodiment of this invention the prior art has essentially proceeded along two approaches in the obtainment of paper products which are characterized as having wet-strength, bulkiness, and water absorbency. These two approaches are: (1) machine process means, and (2) cmpositional variables, such as the particular classes of fiber pulp employed and the identity of chemical additives, where said additives are predominantly a means to enhance wet-strength.

With respect to the addition of chemical agents to enhance wet-strength, the following patents are representative of the art: U.S. Pat. No. 3,058,873, granted Oct. 16, 1962, and Canadian Pat. No. 828,656, granted Dec. 2, 1969. These patents generally teach the sequential or simultaneous addition of various chemical agents to the pulp furnish prior to web formation. These agents can be divided into two basic categories: anionic and cationic. Typical of cationic agents are metal salts, such as alum, and organic compounds, such as urea-formaldehyde and melamine-formaldehyde resins, polyalkylene polyamines, polyamides and derivatives thereof such as polyamide-epichlorohydrin reaction products. Typical of the anionic agents are clays, such as bentonite and various gums, starches, vinyl copolymers of carboxylic acids, and cellulose derivatives, such as carboxymethylcellulose.

Whatever the identity of the additive or combination of additives, it is generally recognized that the process technique of developing wet-strength by the addition of chemical additives is satisfactory in most part, but there are certain difficulties. For example, in the manufacture of wet-strength papers an appreciable to significant amount of the wet-strength agent, added at a point upstream from sheeting (e.g., at the beater, pulp chest, or headbox), is lost in the white water. Another difficulty results when anionic and cationic agents are added, since to a significant extent these agents tend to agglomerate or react with each other without fiber deposition and, therefore, do not impart any functional benefit to the ultimate paper product. Also, to date, no method of enhancing wet-strength by addition of chemical additives functions to enhance the softness or bulkiness of the resultant paper product. Indeed, use of wet-strength agents almost invariably causes increased harshness and reduced softness. Bulkiness, softness and water absorbency are related characteristics and to date these characteristics have been imparted to paper products largely by processing means which require special equipment.

U.S. Pat. No. 3,301,746, granted Jan. 31, 1967, illustrates one process means for preparing bulky paper sheets having a highly desirable combination of softness, bulk and absorbency characteristics such that the resulting product is ideally suited for toweling and sanitary purposes. These desirable characteristics are engendered by a particular technique used in the formation, transfer and drying of the advancing paper web such that mechanical compaction is limited to a repeating point array on the surface of the web.

Thus, conventional process means of enhancing bulkiness of a paper product are largely operational features which minimize compression of the continuous web prior to final drying; for it is well-known in the art that substantial compression of the web prior to final drying irreversibly reduces the caliper of the resulting paper product. Also, common to most prior art procedures for the production of bulky paper from wood pulp is a requirement that a substantial proportion of the fibers have a length of approximately 3 millimeters, that is, are classifiable in the art as long fibers as opposed to short fibers which typically have a fiber length of approximately 1 to 2 mm. This common requirement reflects the fact that in bulky paper products the forces holding the fibers intact are largely that of a physical nature where ultimate tensile strength is directly proportional to fiber length, i.e., the strength is derived from a mechanical entanglement of the long fibers which cannot be achieved with a furnish composed of substantially all short fibers.

Accordingly, it is an object of this invention to provide a process wherein short papermaking fibers acquire the desirable characteristics of long papermaking fibers.

A second object of this invention is to provide bulky fibrous assemblies, such as paper sheets, wherein short fibers are present as discrete fiber aggregates as at least a substantial component thereof.

A third object of this invention is to provide a process whereby bulky fibrous assemblies, such as paper sheets, can be manufactured from short fibers. It should be noted that while this invention is primarily concerned with the utilization of short fibers for economic reasons the invention contemplates the use of fibers of any length whether the fibers be naturally occurring or synthetic.

A fourth object of this invention is to provide fibrous assemblies, such as bulky paper products exhibiting a characteristic softness impression which also have enhanced wet-strength.

A fifth object of this invention is to provide a process for the production of fibrous assemblies, such as bulky paper products, which exhibit wet compaction resistance, that is, are possessed of a caliper which is substantially independent of the state of hydration of said fibrous assemblies; a complementary object is a product characterized in part by such wet compaction resistance.

SUMMARY OF THE INVENTION

Applicants have developed a novel process and products stemming therefrom, which process broadly stated comprises combining a slurry of cationically charged fibers with a slurry of anionically charged fibers and forming, or collecting, the resultant discrete fibrous aggregates into formed products such as paper. The charge on the fibers in the cationic slurry is achieved by treating the fibers (wet or dry) with fiber-substantive cationic chemical agents. In the slurries of anionically charged fibers, charge is achieved by treating the fibers (wet or dry) with fiber-substantive anionic chemical agents, or by enhancing the native negative charge of the fiber itself, such as, with respect to cellulose, by mild oxidation of cellulose fibers. The discrete fibrous aggregates contribute an apparent increased fiber length effect in fibrous assemblies wherein they are incorporated together with other surprising effects related to bulk, absorbency, compaction resistance, and enhanced wet-strength without sacrifice of softness and drape.

The fiber aggregates themselves, characterized by a random space relationship of from two to thousands of individual fibers, may be obtained in discrete form by transferring the aggregates from the initial flocculating medium to a medium of lower dielectric constant with subsequent drying for later use in fibrous assemblies produced by any of the conventional wet, dry or textile techniques.

In the wet-laid formation techniques the fiber aggregates are formed during the concentration of the individual charged fiber slurries and in subsequent web formation stages according to the overall process:

1. mixing a previously prepared slurry volume of cationically charged fibers with a previously prepared slurry volume of anionically charged fibers in a mixing zone; wherein said cationically charged fiber slurry is prepared from fibers treated at a level of from about 0.1 to about 10.0 wt. %, based on fiber dry weight, with a fiber-substantive cationic agent and wherein said anionically charged fiber slurry is prepared from fibers treated at a level of from about 0.1 to about 10.0 wt. %, based on fiber dry weight, with a fiber-substantive anionic agent; and simultaneously or immediately thereafter
2. collecting the fiber aggregates obtained from said mixing zone of step (1) to permit draining and ultimate drying.

The product aspect of this invention provides fibrous assemblies consisting either entirely or substantially of short fibers or either natural or synthetic origin; where said product is characterized by a compaction resistant intrinsic bulk, by enhanced wet-strength, softness, drape, and absorbency.

DETAILED DESCRIPTION OF THE INVENTION

The essence of this invention is the unexpected discovery that when separate aliquots of a fiber slurry, such as a paper pulp slurry, are treated, one with a cationic material and the other with an anionic material, then the two fiber slurry aliquots on combination flocculate in discrete aggregates in such a manner that fibrous assemblies formed therefrom, such as sheets or continuous webs, exhibit the following properties after drying: apparent increase in fiber length, enhanced wet-strength without sacrifice of softness and drape, a compaction resistant bulk, and absorbency. These and other unexpected propeties are in part a function of the nature of the fiber since, as indicated above, this invention encompasses a full range of fibers (e.g., cellulose to glass) which differ markedly in such properties as affinity for water.

In addition to the above-listed attributes of the product per se, the instant invention provides two important advantages which are related to process conditions. These advantages are a direct consequence of the flocculation achieved by the novel processing step of mixing separate slurries of cationically and anionically charged fibers, namely: the utilization of short fibers, an economic advantage; and a second advantage related to the extent and efficiency of flocculation of the short fibers, namely: by consequence of the novel processing step of mixing cationically and anionically charged fibers, the short fibers can be made to acquire the properties of longer fibers so that relatively wide screen wire can be used to advance the continuous web issuing from the mixing zone where the separate slurries (one composed of cationically charged fibers and the other composed of anionically charged fibers) are first contacted and mixed. The result is that conventional equipment designed for use with long pulp fibers may be utilized in this invention. Additional advantages such as faster drain rate and minimized loss of fiber solids in the white water will be recognized by those skilled in the art.

Having stated the essence of the invention a detailed description of the invention is best presented by a discussion of three topics: (A) Materials, (B) Processing Conditions, and (C) Characterization and Illustration of Products.

A. Materials

As mentioned earlier, the instant invention contemplates utilization of all fibers whether of natural or synthetic origin; however cellulosic fibers are of principal interest. But whatever the identity of the fiber, it is to be emphasized that short fibers may be advantageously employed since, by the practice of this invention, short fibers are made to acquire the characteristics of long fibers. As noted above, the fiber length terms, "long" and "short", have acquired a definite meaning in the paper-making and allied arts. But it is to be emphasized that while one embodiment of this invention calls for exclusive utilization of short fibers — for reasons of which economy is a significant one — the invention also contemplates the use of fiber blends. Thus, blends of long and short fibers, and blends of natural and synthetic fibers are fully contemplated by this invention.

The criteria for selection of the cationic and anionic chemical additives can be generally stated. The additives must first be capable of affixation to the fiber whether by means of chemical bond or by some process of adsorption. The term 'fiber-substantive' is used herein to describe that capacity of affixation, e.g., with respect to cellulose fibers, the term is 'cellulose-substantive'. Secondly, by definition, the additive must possess polarizable functional groups which give it either a predominately cationic or anionic character.

Thus, suitable cationic materials for the practice of this invention may be selected from the group consisting of common cationic fabric softening agents, such as certain fiber-substantive quaternary ammonium compounds; common wet-strength additives, such as the urea-formaldehyde and melamine-formaldehyde resins; aminopolyamide reaction products with epichlorohydrin, such as the commercially available resin, Kymene, from Hercules, Inc., and cationic materials obtained by the reaction of polyalkylene polyamines with polysaccharides, such as starch, Irish moss extract, gum, tragacanth, dextrin, Veegum, carboxymethylcellulose, locust bean gum, Shiraz gum, Zanzibar gum, Karaya gum, agar agar, guar gum, psyllium seed extract, gum arabic, gum acacia, Senegal gum, algin, British gum, flaxseed extract, ghatti, Iceland moss extract and quince seed extract. These and other suitable fiber-substantive additives are disclosed in the following U.S. Patents, which are incorporated herein by reference: U.S. Pat. Nos. 3,409,500 Nov. 5, 1968) 3,448,005 (June 3, 1969); 2,926,116 (Feb. 23, 1960); and 3,520,774 (July 14, 1970); 3,469,569 (Mar. 14, 1972), and 3,686,025 (Aug. 22, 1972) Among the most preferred cationic materials are Parez-630NC, a modified polyacrylamide obtained from American Cyanamid, Kymene, urea-formaldehyde and melamine-formaldehyde resins, and quaternary ammonium compounds such as quaternary bis-octadecyl dimethyl ammonium chloride.

Suitable anionic fiber-substantive materials for practice of this invention may be selected from the group consisting of: common anionic fabric softening agents, such as, ethoxylated alcohol sulfates and sulfonates, polycarboxylic acids, and anhydrides, such as polyacrylates, polymethacrylates, maleic anhydride-vinyl acetate polymers, polyvinyl methyl ether-maleic anhydride copolymers, such as the commercially available Gantrez-AN119 from GAE, methacrylic acid-acrylamide copolymers, isopropenyl acetate-maleic anhydride copolymers, itaconic acid-vinyl acetate copolymers, $\alpha$-methyl styrene-maleic anhydride copolymers, styrene-maleic anhydride copolymers, methylmethacrylate-maleic anhydride copolymers, acrylic acid-stryene copolymers, carboxymethylcellulose, succinic-half-ester of cellulose, graft polymerized polyacrylate-polysaccharide copolymers, succinic-half-esters of starch, oxidation products of the above listed polysaccharides, and certain clays, such as bentonite. These and other suitable fiber-substantive anionic materials are disclosed in the above-listed U.S. patents. The most preferred anionic materials are carboxymethylcellulose, Gantrez-AN119, polyacrylic acid, bentonite, and starch-acrylate graft polymer.

In the sense that the cationic and anionic materials are paired or matched so as to optimize the forces of electrostatic attraction during flocculation, it is necessary to introduce a convenient classification scheme encompassing the above-listed additives. This scheme is based on what may be called the 'charge density' of any particular cationic or anionic material. Thus, in functional terms, charge density is a measure of the number of polarizable functional groups per molecular unit. For example the Parez-630-NC is considered to have a low cationic charge density in comparison with Kymene. The classification scheme is admittedly relative, but it is useful in pairing off a given cationic additive with a suitable anionic additive, and in this manner it is possible to make a near stoichiometric balance of the two oppositely charged additives, when desired; but stoichiometric balance is not critical to the practice of this invention. Also, it should be apparent that the charge density value controls, in a relative fashion, the usage level of the additives; that is, to produce a given product of this invention with certain stated properties of tensile strength and bulkiness, lesser amounts of an additive of a certain charge density will be required than an additive of lower charge density, other things equal. While selection of paired additives and usage levels is largely an empirical determination, such determination, however, is well within the routine operations of one skilled in the art in view of the above outlined principles of selection. Thus, suitable pairs encompass all possible pairings of members selected from the group of the above-listed cationic materials with members selected from the group of the above-listed anionic materials. Representative preferred pairings are, for example:

Parez - 630 NC - Carboxymethylcellulose
Kymene - Carboxymethylcellulose
Urea-formaldehyde - Carboxymethylcellulose
Melamine-formaldehyde - Carboxymethylcellulose
Parez - 630 NC - Gantrez - AN119
Kymene - Gantrez-AN119
Urea-formaldehyde - Gantrez-AN119
Melamine-formaldehyde - Gantrez-AN119
Parez - 630 NC - Polyacrylic acid
Kymene - Polyacrylic acid
Urea-formaldehyde - Polyacrylic acid
Melamine-formaldehyde - Polyacrylic acid
Parez - 630 NC -Bentonite
Kymene - Bentonite
Urea-formaldehyde - Bentonite
Melamine-formaldehyde - Bentonite
Parez - 630 NC - Starch-acrylate graft polymer
Kymene - Starch-acrylate graft polymer
Urea-formaldehyde - Starch-acrylate graft polymer
Melamine-formaldehyde - Starch-acrylate graft polymer B. Processing Conditions The overall process comprises three distinct stages: (1) charging the fibers (2) mixing and flocculation of the charged fibers to form discrete fiber aggregates; and (3) collection and drying of the aggregates. The last two stages may occur sequentially or simultaneously. The last mentioned stage may be carried out with standard procedures and apparatus of the art.

The fiber charging stage is analogous to the commercial manufacture of wet-strengthened paper in that the instant fiber-substantive cationic/anionic materials may be introduced in the furnish at a number of points in the stock preparation system. For example, introduction may occur at the end of the beater or hydropulper cycle, at the stock chest, at the consistency regulator, machine chest, fan pump, or at the head box. The instant charging stage differs, however, from traditional stock preparation systems in that provision must be made for bifurcation of the furnish stream such that one branch may be treated with a cationic fiber-substantive additive, the other with an anionic fiber-substantive additive prior to recombination (mixing stage)

of the furnish branches at the head box. For reason of economy, it is preferable to split the furnish stream at a point near the head box; thus avoiding needless duplication of stock preparation equipment. A dual stock chest system is convenient for this purpose as is also a dual head box wherein introduction of the respective additives may be effected prior to mixing (fiber flocculation) of the separately treated furnish and sheeting.

At whatever the point of introduction in the furnish, the extent of agitation, time for adsorption or reaction to occur (dwell time), and other operational variables are chiefly determined by the identity of the fiber and the identity of the fiber-substantive cationic/anionic additive.

The second stage, mixing, generally stated, simply involves mixing of the oppositely charged fiber slurries within a mixing zone immediately prior to sheeting. Agitation must be provided to control the size of the resulting fiber aggregates; thus insuring uniform sheeting. The operation can be batchwise, or can be continuous. For example, as a continuous operation, it has been found that dual head boxes flowing to a common mixing zone which empties directly onto a moving wire screen, is ideally suited for trouble-free and continuous performance. Operational variations of this system will be readily apparent to those skilled in the art.

C. Characterization and Illustration of Product

In general, the paper product embodiment of this invention is characterized as comprising from about 0.1 to about 10.0 wt. % of a fiber-substantive anionic chemical additive and from about 0.1 to about 10.0 wt. % of a fiber-substantive cationic chemical additive, a caliper or thickness ranging from about 0.003 to about 0.5 inches. Further, the instant paper products are characterized by enhanced wet strength without sacrifice of softness and drape; and still further, by a compaction resistance, that is, a bulk which persists even though the paper product be re-wet. Further illustration and characterization is best presented by a series of actual examples.

EXAMPLE I

Fiber Charging by Treating Aqueous Fiber Slurries with Fiber-Substantive Anionic/Cationic Chemical Additives In general, and with respect to paper making, suitable fibers are charged by adding to an aqueous fiber slurry of from about 0.5 to about 25.0 wt.% fiber solids a selected cationic or anionic additive in the amount of from about 0.1 to about 10.0% (dry weight basis). As explained above, in each case the extent of mixing, dwell time and other operational variables are determined by the identity of the fiber, the identity of the additive, and the point of introduction in the furnish system. For example, sulfite polar short fibers (average fiber length, 1 mm.) were made cationic by adding 10 wt. % Parez-630 NC, dry weight basis, to a 4.0% slurry and stirring gently for a few minutes. The fibers were instantly rendered cationic as evidenced by migration in an electric field. For purposes of later study, the fibers were drained of excess moisture and stored in plastic bags under refrigeration.

Anionic fibers were prepared by reacting the sulfite poplar short fibers with 5.0 wt.% Gantrez-AN 119, dry weight basis. The anhydride groups of the Gantrez polymer reacted with the cellulose hydroxyls to form ester linkages. After hydrolysis of unreacted anhydride groups at a pH of 9.0, the fibers were seen to be anionic by migration in an electric field. These fibers were also drained and stored damp under refrigeration for subsequent use.

As in Example I, substantially equivalent cationic charging results are achieved when the Parez-630 NC is replaced by Kymene, a urea-formaldehyde resin of molecular weight 1400, a melamine formaldehyde resin of molecular weight 1600, and quaternary bis-octadecyldimethyl ammonium chloride, all at a level of 2.0 wt.%, dry weight basis, respectively. And substantially equivalent anionic charging is achieved as in Example I when the Gantrez is replaced by a polyacrylate of molecular weight 1000, a polymethacrylate of molecular weight 1500, maleic anhydride-vinyl acetate copolymer of molecular weight 10,000, a copolymer of methacrylic acid and acrylamide of molecular weight 1000, a copolymer of isopropenylacetate-maleic anhydride of molecular weight 1600, carboxymethylcellulose, a copolymer of styrene-maleic anhydride of a molecular weight 1600, and bentonite, all at a usage level of 2.0 wt.%, dry weight basis, respectively.

EXAMPLE II

Mixing and Flocculation to Form Discrete Fiber Aggregates from Slurries of Cationically Charged Fibers and Anionically Charged Fibers The second stage of the process, mixing and flocculation, can be illustrated specifically using the Kymene and Gantrez treated fiber pulp of Example I. Equal weights of the above described fibers were slurried in water to obtain 0.05 wt.% fiber slurries. On mixing the slurries, the fibers flocculated strongly. The flocculated fibers were easily picked up by a coarse mesh screen—one typically employed for products made from long paper making fiber pulp. Thus, showing that the cationic-anionic short fiber system can be treated as fiber assemblies constituted from longer fiber systems. This is an unexpected advantage, since utilization of coarse screens allows for faster drainage and permits the utilization of conventional paper making machinery.

It is not critical that the charged slurries be mixed in any particular ratio; certainly, stoichiometric balance is not required. Using the above described Kymene-Gantrez system, substantially equivalent flocculation results are obtained when the ratio (by weight) of cationically charged fibers to anionically charged fibers is 3:1, and when the ratio is 1:3.

EXAMPLE III

Preparation of Handsheets

Using charged fiber pulps as prepared in Example I, handsheets were prepared with a deckle box having a wire screen of 100 mesh. The deckle box was equipped with agitation means to control the size of the fiber aggregates forming in the upper half volume of the deckle box, and baffle means placed near the wire screen to create a quiet zone (no turbulence), so that on draining the fiber aggregates would uniformly be distributed over the plane of the screen and produce uniform handsheets.

Fiber pulp slurries of 5.0 wt.% fiber solids were employed. An anionically charged fiber pulp slurry was prepared by treating a slurry volume with 5.0 wt. % Gantrez (based on fiber solids). A cationically charged fiber slurry was similarly prepared using 10 wt. % Parez (based on fiber solids).

The handsheets were subjected to various standard tests, e.g., tensile strength, tear, thickness (a measure related to bulk, which is the inverse of density), and water absorbancy. Table I records relative strength and thickness data for two sample handsheets. Sample 1 was prepared from equal volume slurries of the above-described anionically and cationically treated fibers. Sample 2 was prepared entirely from the cationically treated fibers, and is thus representative of conventional wet-strengthened paper.

TABLE I

| | Properties of Handsheets Prepared from Mixtures of Charged Short Fibers | | | | |
|---|---|---|---|---|---|
| | Fiber Furnish | | Dry | | Thickness |
| | Cationic Fiber | Anionic Fiber | Tensile | Tear | (mils) |
| Sample 1 | 50% | 50% | 1.00 | 1.00 | 4.7 |
| Sample 2 | 100% | | 0.88 | 0.94 | 4.2 |

Table I shows that the instant anionic-cationic fiber handsheets (Sample 1) have enhanced properties of strength and thickness. The thickness value is directly proportional to bulk, since both samples were prepared from otherwise identical slurries, i.e., total fiber weight constant. Further, the bulk of the Sample 1 handsheet was substantially undiminished on re-wetting; whereas the control, Sample 2, showed marked flattening on re-wetting.

EXAMPLE IV

Machine Processed Handsheets

Using the deckle box and fiber pulp slurries of Example III, handsheets were prepared as described for the preparation of Samples 1 and 2 of Example III. Additionally, there was prepared a handsheet entirely from untreated pulp; this handsheet is hereinafter referred to as Sample 3. The handsheet prepared entirely from cationically charged fibers (Parez treatment) is hereinafter referred to as Sample 4. The handsheet representing the instant invention prepared from equal volumes of the cationically and anionically charged fiber pulp slurries is designated as Sample 5. Samples 3, 4 and 5 were prepared under identical conditions, save the fiber pretreatment step.

The handsheets of this example were not dried in a conventional manner. Rather, the wet handsheets were processed and dried according to the process disclosed in commonly assigned U.S. Pat. No. 3,301,746, granted Jan. 31, 1967, which has earlier been discussed. As described, U.S. Pat. No. 3,301,746 minimizes mechanical compaction of the wet-laid web prior to transfer and final drying on a Yankee drum. Operationally, this is achieved by picking the continuously advancing paper web off the travelling wire screen at a point proximally located to a series of suction boxes with an endless fabric belt which has a regular array of embossing cleats, or projections, on its surface. The paper web is then transferred from the endless embossing fabric belt to the Yankee drum in such a manner that mechanical compaction of the web is restricted to a repeating point array occasioned by transfer of the web from the endless embossing fabric belt to the surface of the Yankee drum.

The above-described wet handsheets were transferred from the wire screen of the deckle box to the travelling wire screen to be picked up by the endless fabric embossing belt as detailed above. After drying, these handsheets were subjected to the test summarized in Table II. Table II shows the thickness of the handsheets in three stages: (1) while wet, before drying according to the process of the above described U.S. Pat. No. 3,301,746; (2) the finished product designated in the table as "dry"; and (3) the thickness of the sheets after being thoroughly rewet.

Table II shows that the instant cationic-anionic fiber system handsheet (Sample 5) lost only 7.7% of its thickness on rewetting; whereas the wet-strength control (Parez treated pulp, Sample 4) suffered a 25% loss in thickness on rewetting. Table II also shows that the absolute thickness value of the rewet instant product was 200% greater than the untreated control (Sample 3). As mentioned in Example II, these thickness values are directly proportional to bulk.

TABLE II

| | Thickness Data from Machine Processed Handsheets | | | | |
|---|---|---|---|---|---|
| | Fiber Furnish | | Thickness (mils) | | |
| | Cationic Fiber | Anionic Fiber | Wet | Dry | Rewet |
| Sample 3 | Untreated Control | | 8 | 8 | 6 |
| Sample 4 | 100% | — | 10 | 10 | 7 |
| Sample 5 | 50% | 50% | 10 | 13 | 12 |

Substantially equivalent results are obtained when the anionically charged fibers of Example IV (Gantrez-treated) are replaced with fibers treated at a level of 1.0 wt. % Gantrez, dry fiber basis, and the cationically charged fibers of Example IV (Parez-treated) are replaced with fibers treated at a level of 2.0 wt. % Parez, dry fiber basis.

As in Example IV, substantially equivalent results are obtained when the Parez-treated fiber pulp of Example IV is replaced with Kymene treated fiber pulp at a usage level of 0.5 wt. %, dry fiber basis; and the Gantrez-treated fiber pulp of Example IV is replaced with carboxymethylcellulose-treated fiber pulp at a usage level of 0.5 wt. %, dry fiber basis.

EXAMPLE V

Continuous Formation of the Instant Cationic-Anionic Fiber Assemblies

To illustrate the continuous formation of the instant cationic-anionic fiber assemblies, a conventional Fourdrinier paper machine was modified to the extent that the conventional head box was replaced by a dual head box system which was equipped with stirring means and a common exit slit which served both as a mixing zone for the oppositely charged fiber slurries and as a means to define the flocculated fiber mixture onto the moving wire screen such that a continuous web was formed. Also, since it was known from the handsheet tests, described in the preceding examples, that fibrous assemblies formed from mixtures of cationic and anionic fibers could be collected on relatively large mesh screen, copper screening with 20 wires per inch was used instead of the much slower draining fine screen mesh (100 wires per inch), which is conventionally used with short fiber furnish.

In this example sulfite poplar short fiber pulps were charged with Gantrez at a 5.0 wt. %, based on fiber solids, to obtain an anionically charged fiber pulp slurry. Cationically charged fiber pulp slurries were obtained by treating at a level of 10.0 wt. %, based on fiber solids, with either Kymene or Parez.

Table III summarizes the properties of the paper sheets made with the indicated furnishes with respect to relative strength (tensile and tear) and thickness. Also given in Table III is the percent retention of the fibrous assemblies on the wire screen, a measure of pulp loss in the white water.

In Table III, Sample 1 corresponds to the untreated control. Sample 2 corresponds to a conventional wet strengthened paper, i.e., a furnish consisting entirely of Parez-treated pulp. Sample 3 was obtained from equal furnish volumes of Parez-treated and Gantrez-treated pulps. In Sample 4, the anionic furnish, amounting to 50% of the total, was the Gantrez-treated pulp and the cationic furnish was an equal volume blend of Parez- and Kymene-treated pulp. The data illustrates the superior retention, thickness and strength of the instant products over the conventional products.

TABLE III

Properties of Sheets Formed on a Paper Machine

| | Fiber Furnish | | | | | | | |
|---|---|---|---|---|---|---|---|---|
| | Cationic Fiber | | Anionic Fiber | | | | | |
| | Amt. | Pretreatment | Amt. | Pretreatment | Tensile | Tear | Caliper (mils) | Retention % |
| Sample 1 | — | — | Untreated control | | 0.53 | 0.55 | 13.0* | 50 |
| Sample 2 | 100% | Parez-treated | 0 | — | 0.97 | 0.67 | 14.0 | 75 |
| Sample 3 | 50% | Parez-treated | 50% | Gantrez-treated | 0.62 | 1.00 | 18.0 | 80 |
| Sample 4 | 25% | Parez-treated | 50% | Gantrez-treated | 1.00 | 0.71 | 17.5 | 100 |
| | 25% | Kymene-treated | | | | | | |

Substantially equivalent results are obtained as in Sample 3 of Example V. When the cationic fiber furnish is replaced by a Parez-treated pulp at a treatment level of 1.0 wt. %, based on fiber solids, and the anionic fiber furnish is replaced by a Gantrez-treated fiber pulp at a treatment level of 1.0 wt. %, based on fiber solids, and the combining ratio of fiber furnish is 3 volumes Parez-treated fiber furnish to 1 volume Gantrez-treated fiber furnish; and when the combining furnish ratio is 1 volume Parez-treated fiber furnish to 3 volumes Gantrez-treated fiber furnish.

As in Sample 3 of Example V substantially equivalent results are obtained when the cationic fiber treating additive, Parez, is replaced at a usage level of 1.0 wt. %, based upon fiber solids, with a urea-formaldehyde resin of molecular weight 1600, a melamine-formaldehyde resin of molecular weight 1600, and quaternary bis-octadecyldimethyl ammonium chloride, respectively, and the anionic treating additive, Gantrez, is replaced by carboxymethylcellulose at a usage level of 1.0 wt. %, based on fiber solids.

As in Sample 3 of Example V substantially equivalent results are obtained when the cationic treating agent, Parez, is replaced by bis-octadecyldimethyl ammonium chloride at a usage level of 1.0 wt. %, based on fiber solids, and the anionic treating agent, Gantrez, is replaced with maleic anhydride-vinylacetate copolymer of molecular weight 10,000 at a usage level of 1.0 wt. %, based on fiber solids, by bentonite at a usage level of 3.0 wt. %, based on fiber solids, and by carboxymethylcellulose at a usage level of 4.0 wt. %, based on fiber solids, respectively.

As in Sample 3 of Example V substantially equivalent results are obtained when the sulfite poplar short fiber pulp is replaced by esparto fiber, cotton seed hairs, Kraft softwood fiber, and jute fiber.

What is claimed is:

1. A process for the preparation of fibrous assemblies comprising the steps of:

a. forming separate anionically charged and cationically charged slurry aliquots of a single slurry stock, wherein said cationically charged aliquot is prepared from fibers treated at a level of from about 0,1% to about 10.0%, fiber dry weight basis, with a cationic fiber-substantive agent and wherein said anionically charged aliquot is prepared from like fibers treated at a level of from about 0.1% to about 10.0%, fiber dry weight basis, with an anionic fiber-substantive agent;

b. mixing said anionically charged aliquot and said cationically charged aliquot in a mixing zone, simultaneously or immediately thereafter;

c. collecting the resulting discrete fiber aggregates; and d. draining and drying said aggregates.

2. The process of claim 1 wherein the cationic fiber-substantive agent is selected from the group consisting of: metal salts, quaternary ammonium salts, urea-formaldehyde resin, melamine-formaldehyde resin, polyalkylene polyamines, polyamides, polyamide-epichlorohydrin reaction products, and polyalkylene polyamine-polysaccharide reaction products; and the anionic fiber-substantive agent is selected from the group consisting of: bentonite carboxylated polysaccharides, polycarboxylic acids and anhydrides thereof, and ethoxylated alcohol sulfates and sulfonates.

3. The process of claim 1 wherein the fiber is cellulosic.

4. The process of claim 3 wherein the anionically charged fiber slurry is prepared from oxidized cellulosic fibers.

5. A process for the production of cellulosic fibrous assemblies comprising the steps of:

a. forming separate anionically charged and cationically charged slurry aliquots of a single slurry stock, wherein said cationically charged aliquot is prepared from fibers treated at a level of from about 0.1% to about 10.0%, fiber dry weight basis, with a cationic cellulose fiber-substantive agent selected from the group consisting of metal salts, quaternary ammonium salts, urea-formaldehyde resin, melamine-formaldehyde resin, polyalkylene polyamines, polyamides, polyamide-epichlorohydrin reaction products, and polyalkylene polyamine-polysaccharide reaction products, and wherein said anionically charged aliquot is prepared from fibers treated at a level of from about 0.1% to about 10.0%, fiber dry weight basis, with an anionic cellulose fiber-substantive agent selected from the group consisting of bentonite, carboxylated polysaccharides, polycarboxylic acids and anhydrides thereof and ethoxylated alcohol sulfates and sulfonates;

b. mixing said anionically charged aliquot and said cationically charged aliquot in a mixing zone, simultaneously or immediately thereafter;

c. sheeting the resulting discrete fiber aggregates; and
d. draining and drying said aggregates.

6. A cellulosic fibrous assembly comprising fiber aggregates formed by:

a. forming separate anionically charged and cationically charged slurry aliquots of a single slurry stock, wherein said cationically charged aliquot is prepared from fibers treated at a level of from about 0.1% to about 10.0%, fiber dry weight basis, with a cationic cellulose fiber-substantive agent selected from the group consisting of metal salts, quaternary ammonium salts, urea-formaldehyde resin, melamine-formaldehyde resin, polyalkylene polyamines, polyamides, polyamide-epichlorohydrin reaction products, and polyalkylene polyamine-polysaccharide reaction products, and wherein said anionically charged aliquot is prepared from fibers treated at a level of from about 0.1% to about 10.0%, fiber dry weight basis, with an anionic cellulose fiber-substantive agent selected from the group consisting of bentonite, carboxylated polysaccharides, polycarboxylic acids and anhydrides thereof, and ethoxylated alcohol sulfates and sulfonates;
b. mixing said anionically charged aliquot and said cationically charged aliquot in a mixing zone, simultaneously or immediately thereafter;
c. sheeting the resulting discrete fiber aggregates; and
d. draining and drying said aggregates.

* * * * *